US010060167B2

(12) United States Patent
Romero

(10) Patent No.: US 10,060,167 B2
(45) Date of Patent: Aug. 28, 2018

(54) DEADBOLT LATCH ASSEMBLY

(71) Applicant: Spectrum Brands, Inc., Middleton, WI (US)

(72) Inventor: Oscar Romero, Lake Forest, CA (US)

(73) Assignee: Spectrum Brands, Inc., Middleton, WI (US)

( * ) Notice: Subject to any disclaimer, the term of this patent is extended or adjusted under 35 U.S.C. 154(b) by 36 days.

(21) Appl. No.: 14/199,509

(22) Filed: Mar. 6, 2014

(65) Prior Publication Data

US 2014/0265357 A1 Sep. 18, 2014

Related U.S. Application Data

(60) Provisional application No. 61/784,591, filed on Mar. 14, 2013.

(51) Int. Cl.

| | |
|---|---|
| ***E05C 1/06*** | (2006.01) |
| ***E05B 63/00*** | (2006.01) |
| ***E05B 15/00*** | (2006.01) |
| *E05C 1/12* | (2006.01) |
| *E05B 47/00* | (2006.01) |

(52) U.S. Cl.

CPC ..... *E05C 1/06* (2013.01); *E05B 15/0013* (2013.01); *E05B 63/00* (2013.01); *E05B 47/00* (2013.01); *Y10T 292/1016* (2015.04)

(58) Field of Classification Search

CPC .. E05B 15/0013; E05B 63/0017; E05B 63/00; E05B 47/00; E05C 1/00; E05C 1/002; E05C 1/004; E05C 1/08; E05C 1/10; E05C 1/12; E05C 1/16; E05C 1/163; E05C 9/02; E05C 9/021; E05C 9/023; E05C 9/025; E05C 9/026; E05C 9/12; E05C 1/06

USPC ..... 292/137, 163–165, 169, 169.15, 169.17, 292/172, 173, 140, 142, 1.5, DIG. 52, 292/336.5, 337, 279; 70/124, 129, 130, 70/133, 134, 118, 119, 120

See application file for complete search history.

(56) References Cited

U.S. PATENT DOCUMENTS

| | | | | |
|---|---|---|---|---|
| 17,464 A * | 6/1857 | Westcott | ..... | E05C 1/06 292/142 |
| 46,740 A * | 3/1865 | Westcott | ..... | E05C 1/06 292/142 |

(Continued)

FOREIGN PATENT DOCUMENTS

| | | |
|---|---|---|
| AU | 521605 | 4/1982 |
| GB | 167330 | 8/1921 |
| WO | WO 2008/094471 A2 | 8/2008 |

OTHER PUBLICATIONS

International App. No. PCT/US2014/021360, International Preliminary Report on Patentability; dated Sep. 24, 2015.
USPTO, International Search Report; dated Sep. 16, 2014.

*Primary Examiner* — Alyson Marie Merlino
(74) *Attorney, Agent, or Firm* — Merchant & Gould P.C.

(57) ABSTRACT

A deadbolt latch assembly is provided which includes a housing, bolt, slide, and a pivot member. The bolt is movable, at least partially, into and out of the housing. The slide is located inside the housing and coupled to the bolt to move the bolt, at least partially, into and out of the housing. The slide also includes a plurality of slots. The pivot member includes a plurality of cam members extending therefrom. Each cam member is configured to engage one of the plurality of slots on the slide.

22 Claims, 7 Drawing Sheets

(56) References Cited

U.S. PATENT DOCUMENTS 197,910 A * 12/1877 Taylor ..... E05B 65/46 70/134
711,528 A * 10/1902 Richardson ..... E05B 55/005 292/172
1,330,650 A * 2/1920 Zygmunt ..... E05B 63/0017 70/134
1,383,128 A 6/1921 Larsen
2,042,025 A 5/1936 Schlage
2,253,257 A * 8/1941 Wellman ..... E05C 1/16 292/172
2,290,727 A * 7/1942 Ellison ..... E05B 55/12 292/1.5
2,290,728 A 7/1942 Best
2,404,670 A * 7/1946 Udall ..... E05C 19/10 292/122
2,532,630 A * 12/1950 Lickteig ..... E05C 1/06 292/142
2,614,876 A * 10/1952 McConnell ..... E05C 1/163 292/142
2,771,313 A * 11/1956 Blake ..... E05C 1/06 292/142
4,248,068 A 3/1981 Esser et al.
4,502,716 A 3/1985 Tsai
4,687,239 A 8/1987 Lin
5,253,903 A * 10/1993 Daley ..... E05C 9/041 292/142
5,647,617 A 7/1997 Kajuch
6,983,962 B2 * 1/2006 Keightley ..... E05B 15/10 292/142
7,003,990 B2 2/2006 Iliuk
8,256,251 B2 9/2012 Kondratuk
8,267,442 B2 9/2012 Tien et al.
2006/0290141 A1 * 12/2006 VanHellemont .... E05B 63/0004 292/142
2009/0211317 A1 8/2009 Kondratuk

* cited by examiner

DEADBOLT LATCH ASSEMBLY

RELATED APPLICATIONS

The present application is related to and claims priority to U.S. Provisional Patent Application, Ser. No. 61/784,591, filed on Mar. 14, 2013, entitled "Deadbolt Latch Assembly." The subject matter disclosed in that provisional application is hereby expressly incorporated into the present application in its entirety.

TECHNICAL FIELD AND SUMMARY

The present disclosure relates to deadbolt latch assemblies and, more particularly, to a deadbolt latch assembly having a plurality of pivot arms that move a bolt from locked to unlocked positions.

Conventional deadbolts include a deadbolt latch assembly that fits inside a door and is configured so a bolt may selectively extend from the door and into the door jamb to secure or "lock" the door. In order to install the deadbolt, the door requires an edge bore configured to receive the deadbolt latch assembly and cross bore configured to connect the deadbolt latch assembly with the handle assembly. An issue with the cross bore is that despite its size, particularly relative to the edge bore, the deadbolt latch assembly may occupy a relatively large amount of its space. Because the deadbolt latch assembly is generally located in the center of the cross bore, the throw arm that rotates in response to a key or turnpiece extends from the perimeter of the deadbolt latch assembly to occupy even more space inside the cross bore.

In light of the advancements of electronic door-lock technology, combined with the desire for smaller profiles of latch or lock assemblies, a new found importance in the amount of space a deadbolt latch assembly occupies inside the cross bore has emerged. The less space the deadbolt latch assembly and its moving parts occupy, means more available space for other things, such as wires, batteries, motors, gears, etc.

Accordingly, an illustrative embodiment of the present disclosure provides an alternative to the pivoting throw arm that extends from a conventional deadbolt latch assembly to push and pull the deadbolt. In an embodiment, a cam illustratively composed of three slots is disposed in a slide coupled to the deadbolt which moves the deadbolt in and out of the door. A trio of spaced apart cam members rotates about the pivoting axis of a tailpiece so that as either a key or turnpiece rotates, the cam members each engage one of the slots to push or pull the slide—similar to a rack and pinion-type operation. In the conventional design, the throw arm is long enough so that turning the turnpiece about 90 degrees, thereby rotating the arm about 110 degrees, fully extends or retracts the deadbolt. The rack and pinion design disclosed herein employs an about 180 degrees rotation of the turnpiece or key, but requires less force to move the bolt. Without a moving part extending substantially above the profile of the deadbolt latch assembly, more room is available in the cross bore for motors, gears, batteries, wires, or any other like structures.

Another illustrative embodiment of the present disclosure provides a deadbolt latch assembly which comprises a housing, bolt, slide, and a pivot member. The housing includes an outer periphery. The bolt is movable, at least partially, into and out of the housing. The slide is located inside the housing and is coupled to the bolt to move the bolt, at least partially, into and out of the housing. The slide also includes a plurality of slots. The pivot member includes a plurality of cam members extending therefrom. Each cam member of the plurality of cam members is configured to engage one of the plurality of slots on the slide. In addition, each cam member of the plurality of cam members does not extend beyond the outer periphery of the housing when engaged with one of the plurality of slots.

The above and other illustrative embodiments of the deadbolt latch assembly may also include: each of the plurality of cam members extending radially from the pivot member; the pivot member rotating about 180 degrees to fully extend the deadbolt; the pivot member rotating about 180 degrees to fully retract the deadbolt; the plurality of cam members does not extend beyond the outer periphery of the housing when located adjacent the slide; the plurality of cam members includes three spaced apart fingers, and wherein each of the three fingers extends radially from the pivot member; wherein each of the three fingers engages one of the plurality of slots on the slide such that rotation of the pivot member moves the slide; the plurality of cam members uniformly spread torque load when rotating the pivot member; the housing being configured so that there are no moving structures both exterior of the housing above the slide and located in a cross bore in a door; the housing being configured so the housing fits into the same location in a door as a deadbolt latch assembly with a single swing arm; and the pivot member being configured to receive a tailpiece to rotate the pivot member.

Another illustrative embodiment of the present disclosure provides a deadbolt latch assembly which comprises a housing, bolt, slide, a pivot member, and a housing. The bolt is movable, at least partially, into and out of the housing. The slide is located inside the housing and coupled to the bolt to move the bolt, at least partially, into and out of the housing. The slide includes a plurality of slots. The pivot member includes a plurality of cam members extending therefrom. Each cam member is configured to engage one of the plurality of slots on the slide.

The above and other illustrative embodiments of the deadbolt latch assembly may also include: each of the plurality of cam members extends radially from the pivot member; the pivot member rotates about 180 degrees to fully extend the deadbolt; the pivot member rotates about 180 degrees to fully retract the deadbolt; the plurality of cam members includes three spaced apart fingers, and wherein each of the three fingers extends radially from the pivot member; each of the three fingers engaging one of the plurality of slots on the slide such that rotation of the pivot member moves the slide; the plurality of cam members uniformly spreading torque load when rotating the pivot member; and a housing containing the pivot member and slide.

Another illustrative embodiment of the present disclosure provides a deadbolt latch assembly which comprises a housing, a bolt, a slide, and a pivot member. The bolt is movable, at least partially, into and out of the housing. The slide is coupled to the bolt to move the bolt, at least partially, into and out of the housing. The slide also includes at least one slot. The pivot member includes at least one cam member extending therefrom and wherein the at least one cam member is configured to engage the at least one slot.

In the above and other illustrative embodiments, the deadbolt latch assembly may further comprise: at least one cam member being a plurality of cam members, and wherein each of the plurality of cam members extends radially from the pivot member; the pivot member rotates about 180 degrees to fully extend the deadbolt; the pivot member rotates about 180 degrees to fully retract the deadbolt; the plurality of cam members do not extend beyond an outer periphery of the housing when located adjacent the slide; the plurality of cam members include three spaced apart fingers, and wherein each of the three fingers extends radially from the pivot member; each of the three fingers engages one of the plurality of slots on the slide such that rotation of the pivot member moves the slide; the plurality of cam members uniformly spread torque load when rotating the pivot member; the housing being configured so that there are no moving structures both exterior of the housing above the slide and located in a cross bore in a door; the housing being configured so the housing fits into the same location in a door as a deadbolt latch assembly with a single swing arm; and the pivot member being configured to receive a tailpiece to rotate the pivot member.

Additional features and advantages of the deadbolt latch assembly will become apparent to those skilled in the art upon consideration of the following detailed description of the illustrated embodiment exemplifying the best mode of carrying out the deadbolt latch assembly as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the deadbolt latch assembly, and such exemplification is not to be construed as limiting the scope of the deadbolt latch assembly in any manner.

DETAILED DESCRIPTION OF THE DRAWINGS

The deadbolt latch assembly of the present disclosure reduces the size of the deadbolt latch assembly which frees up space in the cross bore to accommodate other components, such as motors, gears, cylinders, batteries, etc. This reduced-sized deadbolt latch assembly is due to a new cam/cam member slide or rack and pinion design in the deadbolt latch assembly that has the effect of being able to rotate the turnpiece about 180 degrees, while using less effort than the traditional 90 to 110 degrees rotation. This deadbolt configuration is amendable to motor-driven deadbolt assemblies, since smaller motors may be able to retract and extend the deadbolt under this lighter load. In an illustrative embodiment, the deadbolt latch of the present disclosure works similar to a rack and pinion mechanism, instead of the traditional single lever arm. The present disclosure employs three shorter slots and rotates about 180 degrees to throw a bolt about 1 inch instead of the prior art single arm rotating 110 degrees to throw the same bolt. In addition, unlike the prior art, the three lever arms, being shorter, create a mechanical advantage of spreading the torque load in a more uniform way, particularly at the beginning and end of the stroke. In other words, there are no peaks like with the single lever arm design where there is a higher load at the beginning or end of the locking and unlocking operation. This ease in effort may be useful under side load conditions on the door, such as weather stripping or door warpage.

Figure 1:
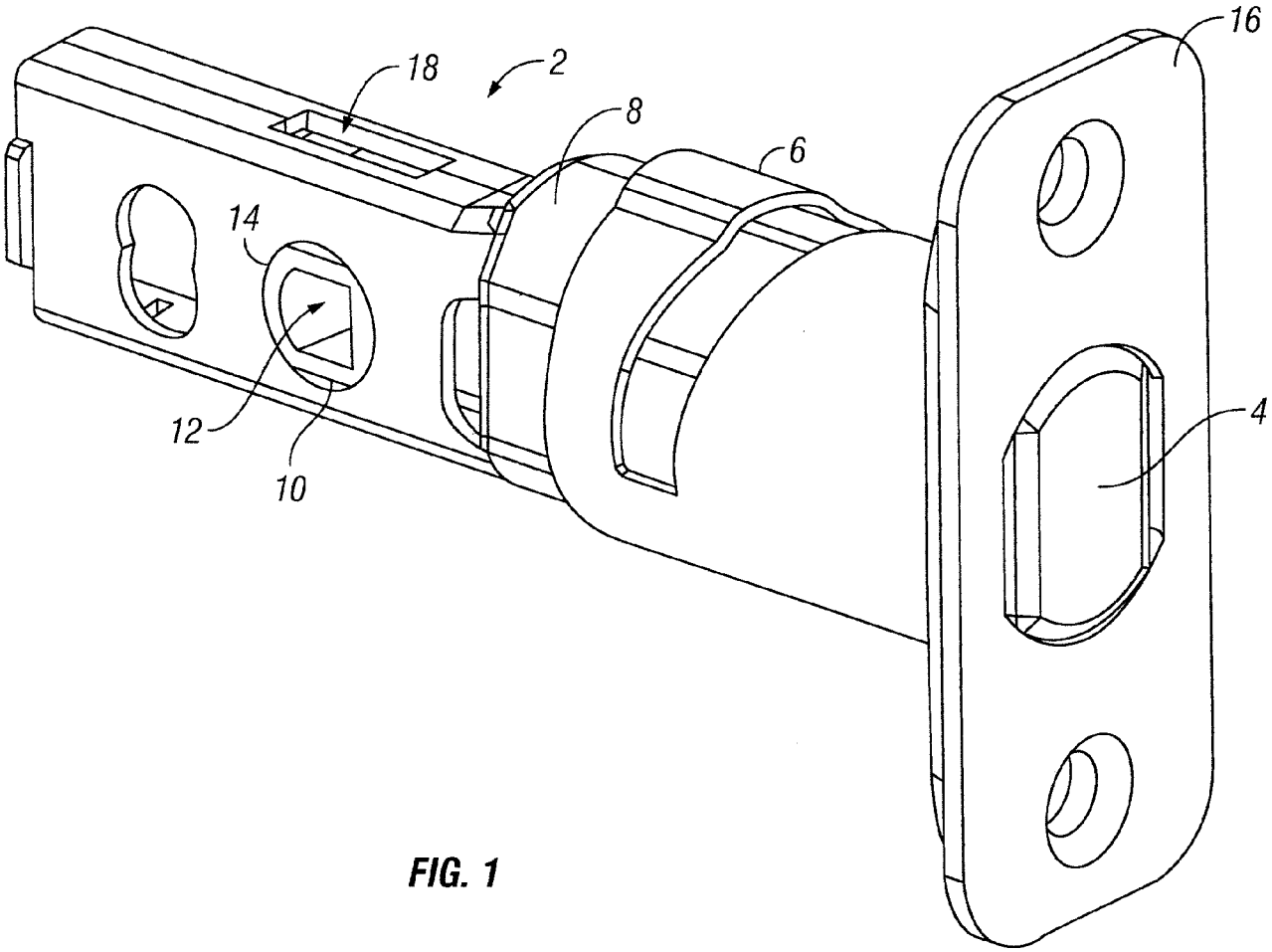
FIG. 1 is a perspective view of a deadbolt latch assembly with a deadbolt retracted therein, and a base plate fitted thereon.

A perspective view of latch set assembly 2 is shown in FIG. 1. This view shows bolt 4 retracted in a sleeve 6. Also located in sleeve 6 is housing 8 which contains both bolt 4 and the throwing mechanism for same. Pivot member 10, with bore 12 disposed therethrough, is shown via opening 14 in housing 8. Also shown in this view is base plate 16 that encircles bolt 4. A slot opening 18 is formed on the top portion of housing 8. The outward appearance of deadbolt latch assembly 2 is similar to that of a conventional deadbolt latch assembly, except there is no throw arm extending from slot opening 18. It is appreciated in one embodiment that deadbolt latch assembly 2 may be used in conjunction with prior art tailpieces making it suitable as a retrofit item.

Figure 2:
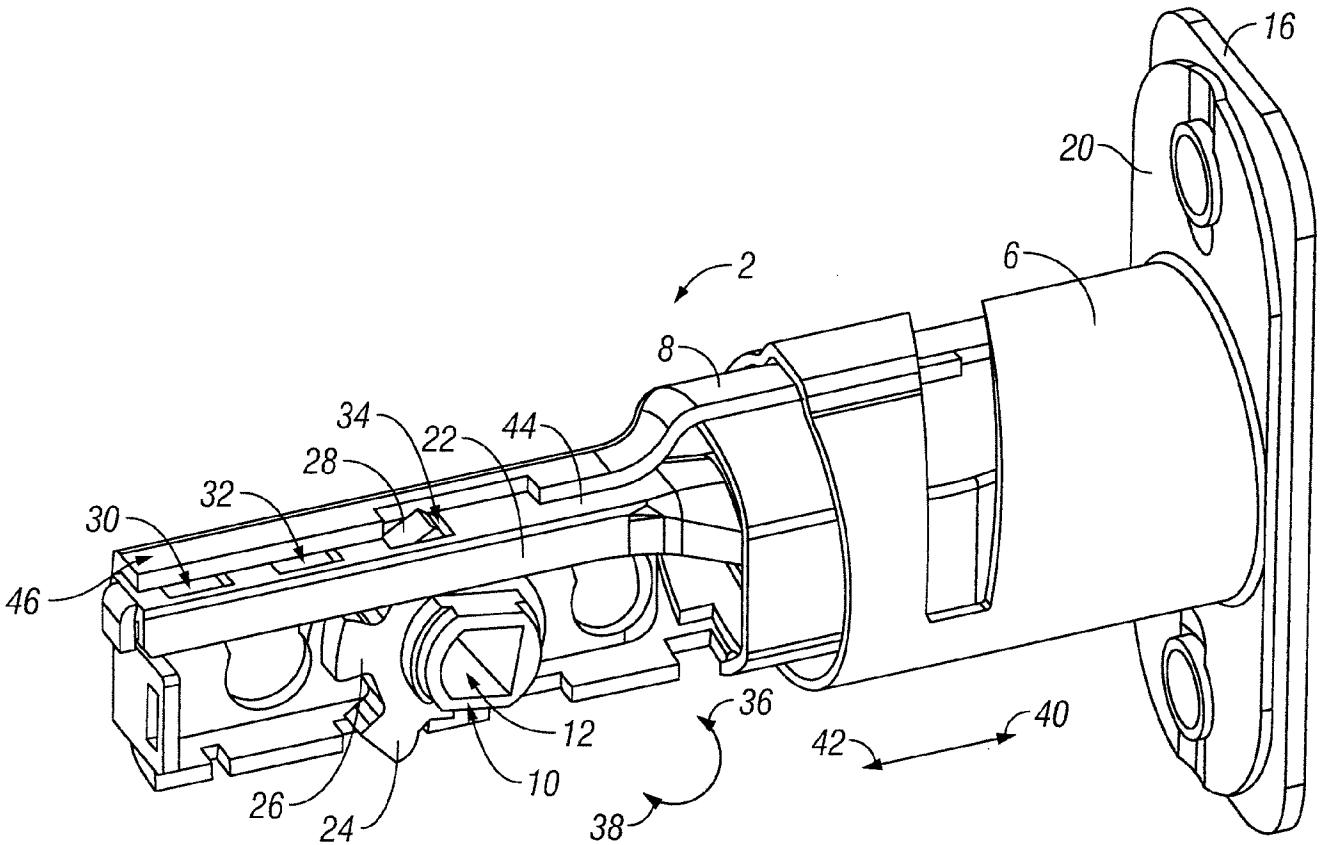
FIG. 2 is a side perspective partially-cross-sectional view of the deadbolt latch assembly of FIG. 1.

A rear perspective view of deadbolt latch assembly 2 in partial cut-away view is shown in FIG. 2. This view shows sleeve 6 attached to back plate 20 which attaches to base plate 16. With part of housing 8 removed, both slide 22 and pivot member 10 are visible. As shown, pivot member 10 includes, illustratively, three fingers 24, 26, and 28. These fingers 24-28 are arranged in a gear-teeth-like manner so that as pivot member 10 rotates, each tooth may engage a corresponding opening in slide 22, such as openings 30, 32. and 34. In this view, tooth 28 is engaged with opening 34 so when pivot member 10 rotates, that engagement will move slide 22. For example, as pivot member 10 rotates in direction 38, the engagement between tooth 28 and opening 34 causes slide 22 to move in direction 40. Continued rotation of pivot member 10 causes tooth 26 to engage opening 32 and then tooth 24 engages opening 30 to continue moving slide 22 in direction 40. Conversely, when pivot member 10 rotates in direction 36, each tooth 28, 26, and 24 still engages its respective opening 34, 32, and 30, but instead now move slide 22 in direction 42 toward end 46 of housing 8, This causes bolt 4. which is attached to slide 22 (see, also, FIG. 3), to either extend from or retract into the deadbolt latch assembly 2.

Bore 12 in pivot member 10 is configured to receive a tailpiece or other extending member from either the key set or turnpiece on the inside or outside of the door. That provides rotational movement. It is also appreciated that an axle or other rotating member may be attached to a motor or gear to create the same rotational movement. In whichever power source is used to create the rotational movement, it is appreciated that the shorter fingers, when compared to traditional pivot arms, will make movement of slide 22 that much easier. To that end, it is further appreciated how fingers 28, 26, and 24 do not appreciably extend above the top surface 44 of slide 22. Typical throw arms extend much further, even beyond the top surface of the housing which requires greater force to initiate movement, as well as reducing usable space in a cross bore. (Compare FIGS. 6 and 7.)

Figure 3:
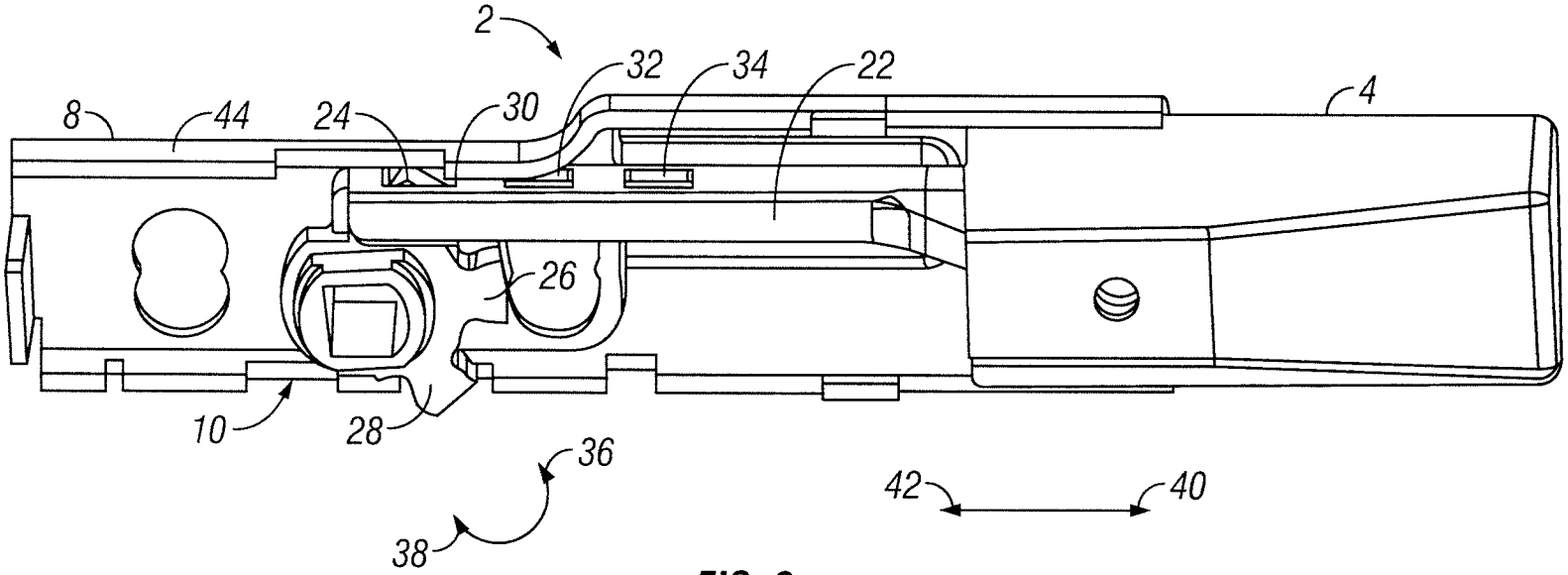
FIG. 3 is a downward-looking cross-sectional side view of a portion of the deadbolt latch assembly of FIG. 1.

A downward-looking side perspective view of deadbolt latch assembly 2 shown in cross-section is shown in FIG. 3. This view shows the position of bolt 4 extended from deadbolt latch assembly 2 when pivot member 10 pushed slide 22 in direction 40. When pivot member 10 rotates in direction 38 (illustratively clockwise), fingers 28, 26, and 24 engage openings 34, 32, and 30, respectively, and in that order, to move slide 22 in direction 40. As shown in this view, finger 24 is still engaged in opening 30. It is appreciated from this view how finger 24 (as well as the other fingers 26 and 28) do not extend above top surface 44 of housing 8. It is appreciated from this view how slide 22 is attached to bolt 4 to move the same back and forth between extended and retracted positions.

Figure 4A:
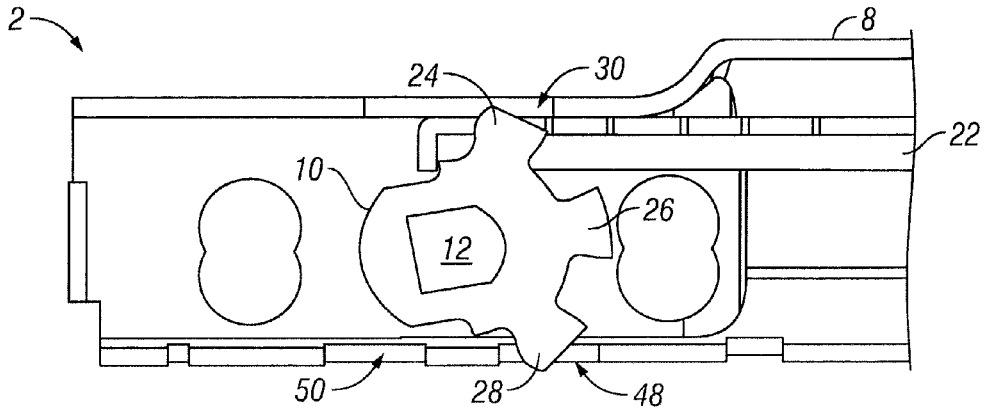
FIGS. 4*a-c* are side cross-sectional detail views of a portion of the deadbolt latch assembly of FIG. 1.
Figure 4B:
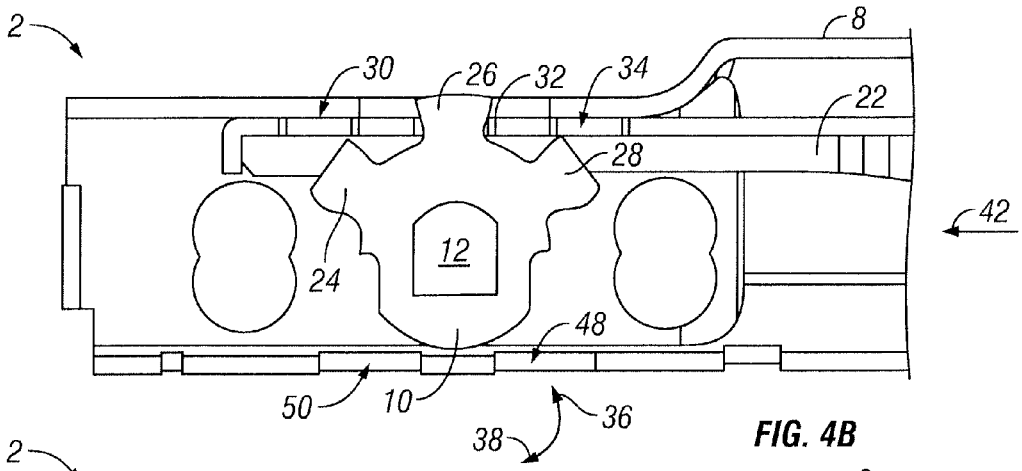
Figure 4C:
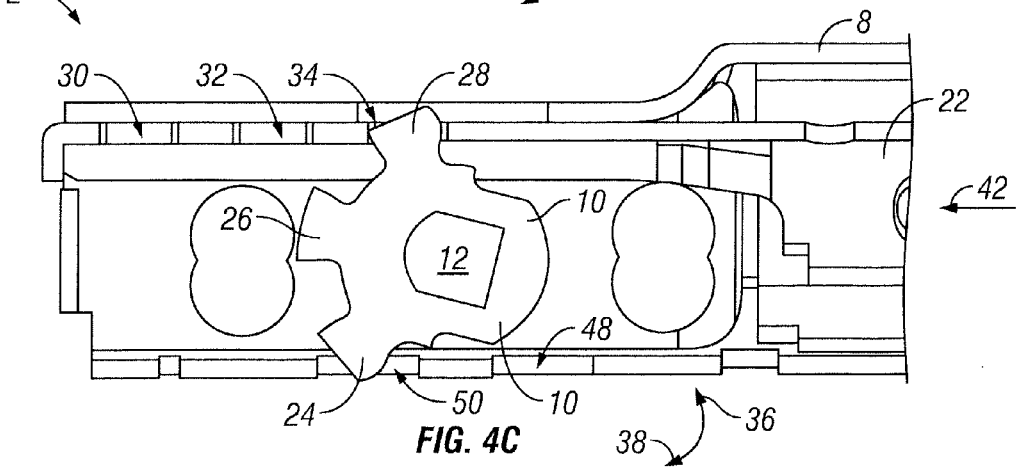

Side cross-sectional views of a portion of deadbolt latch assembly 2 are shown in FIGS. 4 *a-c*. These views constitute a progression view demonstrating how pivot member 10 rotates to move slide 22, in this example, in direction 42 to the retracted position. As shown in FIG. 4 *a*, finger 24 is located in opening 30. In this position, bolt 4 is in its extended position from the door. To retract deadbolt 4, pivot member 10 is rotated in direction 36, causing finger 24. to rotate out of opening 30 and causing finger 26 to engage opening 32 which begins to move slide 22 in direction 42. It is appreciated when comparing FIGS. 4*a* to 4*b* that fingers such as, 28 and 24, may extend beyond the inner periphery of housing 8 engaging openings 48 50, but the extent to which it occurs is minor. (Compare FIGS. 4 *a-c* with finger 58 in FIG. 7.) Further rotation of pivot member 10 in direction 36 continues moving slide 22 in direction. 42. The view shown in FIG. 4 c demonstrates how pivot member 10 continues moving slide 22 in direction 42, Here, pivot member 10 continues rotating in direction 36, which causes finger 26 to exit opening 32 and causes finger 28 to engage opening 34. In so doing, slide 22 is moved further in direction 42. This results in bolt 4 retracting further. As evident by comparing FIGS. 4 *a, b*, and *c*, the concept of a rack and pinion mechanism becomes clear. What is also clear is how, at most, minimal extension from housing 8 by fingers 24,26, and 28 may occur.

Figure 5:
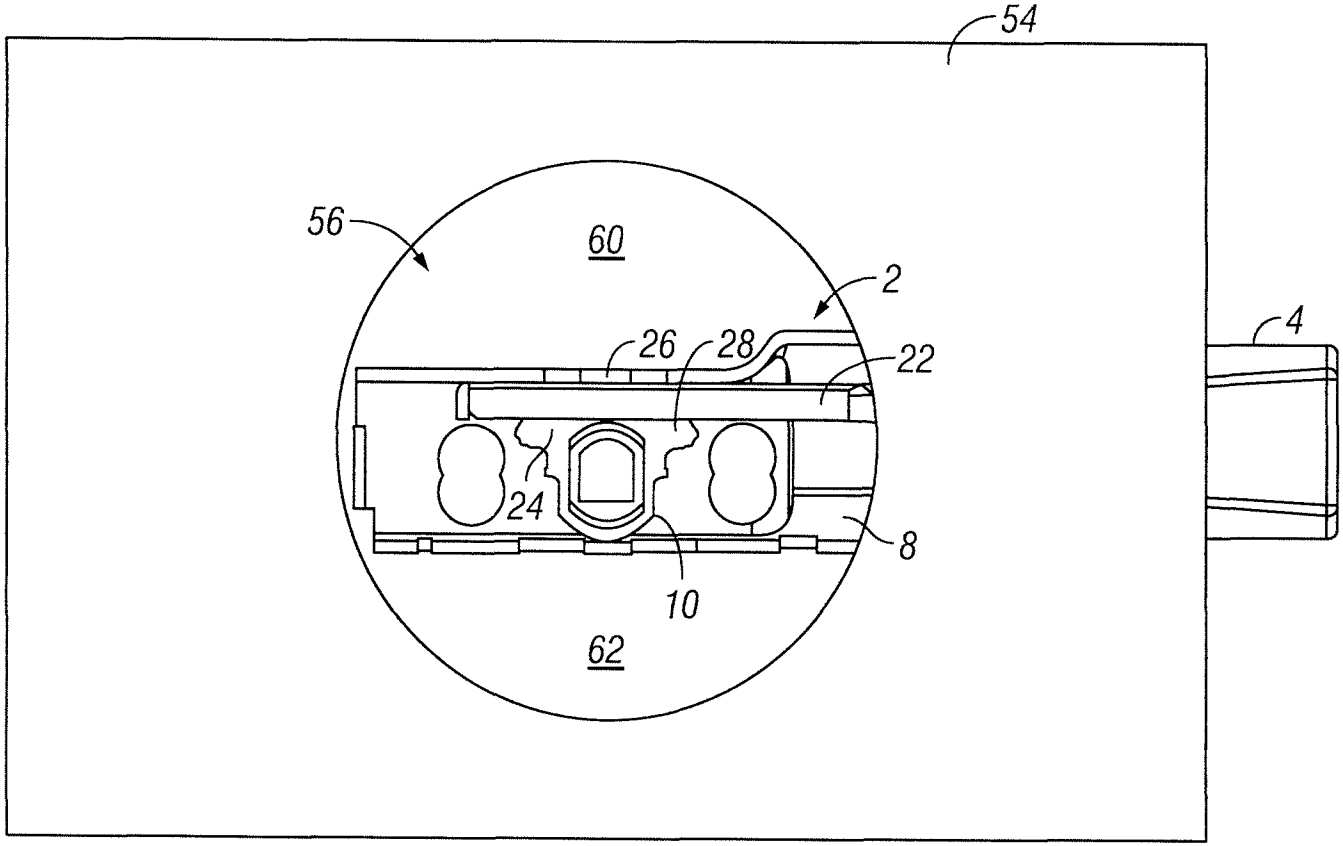
FIG. 5 is a side-cross sectional view of the deadbolt latch assembly fitted in a door and visible through a cross bore drilled in the door.

A side view of a door 54 with deadbolt latch assembly 2 inserted into cross bore 56 is shown in FIG. 5. Deadbolt latch assembly 2 is shown in partial cross-section view and includes pivot member 10 and slide 22. This view demonstrates how much additional room is available because pivot member 10 does not include such a relatively large pivot arm. (See arm 58 in prior art view of FIG. 7.) Shown in FIG. 5, as well as the other views, is fingers 24, 26, and 28 which do not appreciably extend exterior of housing 8, leaving more room in cross bore 56 for other structures. As shown herein, open spaces 60 and 62 in cross bore 56 are available for other uses, such as motors, gears, wires, etc.

Figure 6:
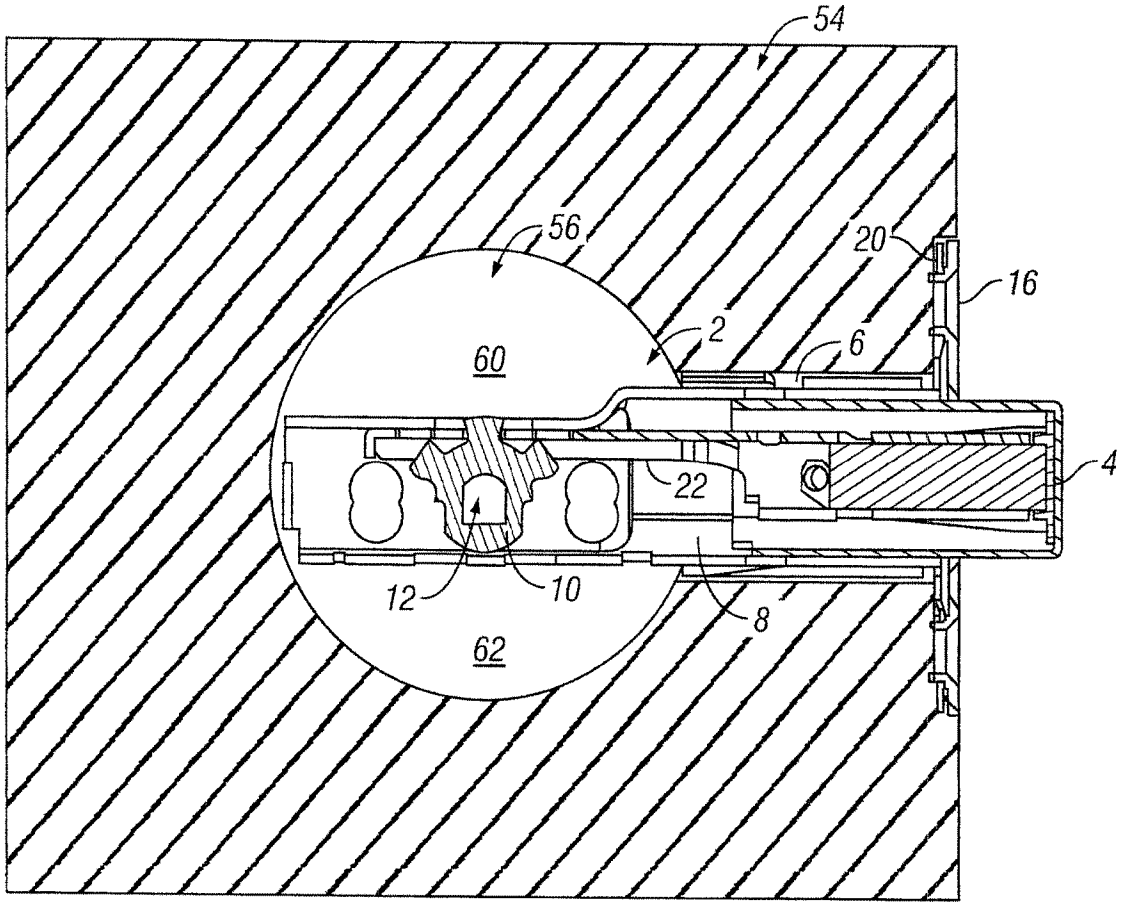
FIG. 6 is a cross-sectional view of the deadbolt latch assembly of FIG. 1 fitted in a door, similar to that shown in FIG. 5, except with the door also shown in cross-sectional view.

A side cross-sectional view of deadbolt latch assembly 2 fitted in door 54 is shown in FIG. 6. This view further reinforces the concepts of a smaller assembly profile. This view also shows how deadbolt latch assembly 2 may still be fitted in a conventional cross bore creating backward-compatibility opportunities. Bolt 4 extends and retracts from door 54 with base plate 16 and back plate 20 positioned there around. Slide 22 located in housing 8 is attached to bolt 4 with pivot member 10 rotatable to extend or retract bolt 4, depending on which way pivot member 10 is rotated. Because many of the structures including sleeve 6, base plate 16, back plate 20, bolt 4, and even the general silhouette of housing 8 are similar to prior art deadbolt latch assemblies, deadbolt latch assembly 2 may be fitted conventionally into door 54. Deadbolt locking structures that have the ability to engage bore 12 of pivot member 10 may be adapted to employ deadbolt latch assembly 2.

Figure 7:
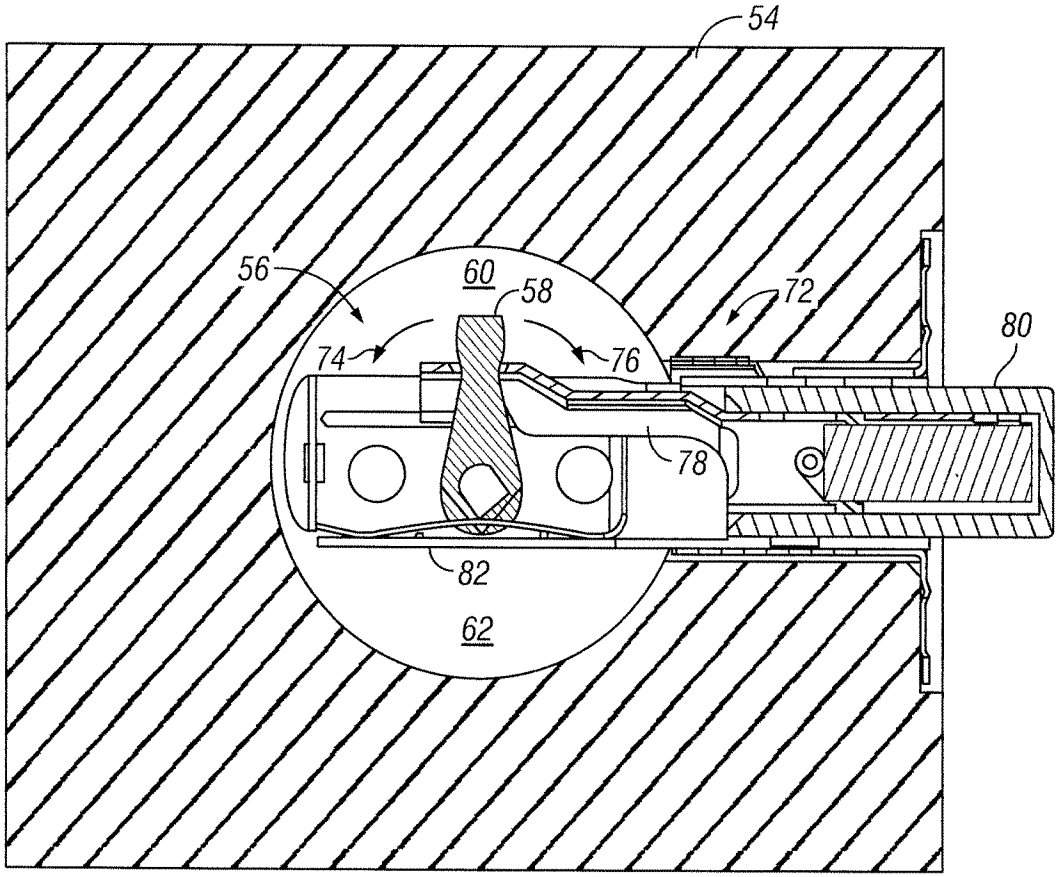
FIG. 7 (Prior Art)
FIG. 7 is a cross-sectional view of a prior art version of a deadbolt latch assembly in the same cross-sectional view, and attached to the door, similar to that shown in FIG. 6.

A cross-sectional view of both a prior art deadbolt latch assembly 72 and a door 54, similar to that shown in FIG. 6, is shown in FIG. 7. This view illustrates how deadbolt latch assembly 2 requires much less space in cross bore 56 than deadbolt latch assembly 72. Arm 58 in FIG. 7 is pivotable in directions 74 and 76, so it can move slide 78 which is attached to bolt 80 in and out of door 54. As this view shows, not only is housing 82 in the prior art version larger, but the substantial extension of arm 58 out of housing 82 substantially reduces space 60, as compared to that same space in FIGS. 5 and 6. This issue is exacerbated in that arm 58 does not only require the space it is shown occupying, but it also needs open space to move right and left so it can push and pull bolt 80 in and out of door 54. This means even more space in open space 60 must be dedicated to arm 58 so there is sufficient clearance as arm 58 moves in directions 74 and 76. It can be appreciated in this view how locating a motor in space 60 will prove very difficult because of the limited space available.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A deadbolt latch assembly comprising:

a housing defining an outer periphery;

a bolt movable relative to the housing between an extended position and a retracted position;

a slide coupled to the bolt; wherein the slide includes a plurality of slots;

a pivot member that includes a plurality of cam members extending therefrom, wherein each cam member of the plurality of cam members is configured to extend through and engage with a corresponding one of the plurality of slots on the slide, wherein the pivot member defines a bore therethrough that is dimensioned to receive a tailpiece of a deadbolt locking assembly to rotate the pivot member;

wherein each cam member of the plurality of cam members does not extend beyond the outer periphery of the housing when extended through and engaged with a corresponding one of the plurality of slots; and wherein the bolt extends at least partially out of the housing to the extended position in response to rotation of the pivot member in a first direction such that the cam members extend through and engage with the slots of the slide to cause the slide to move and thereby extend the bolt to the extended position, and wherein the bolt retracts from the extended position to the retracted position in response to rotation of the pivot member in a second direction such that the cam members extend through and engage with the slots of the slide to cause the slide to move and thereby retract the bolt to the retracted position.

2. The deadbolt latch assembly of claim 1, wherein each of the plurality of cam members extends radially from the pivot member.

3. The deadbolt latch assembly of claim 1, wherein the pivot member rotates in the first direction about 180 degrees to extend the bolt to the extended position.

4. The deadbolt latch assembly of claim 1, wherein the pivot member rotates in the second direction about 180 degrees to retract the bolt from the extended position to the retracted position.

5. The deadbolt latch assembly of claim 1, wherein the plurality of cam members includes three spaced apart fingers, and wherein each of the three fingers extends radially from the pivot member.

6. The deadbolt latch assembly of claim 5, wherein each of the three fingers engages a corresponding one of the plurality of slots on the slide such that rotation of the pivot member moves the slide.

7. The deadbolt latch assembly of claim 1, wherein the plurality of cam members uniformly spread torque load when the pivot member is rotated.

8. The deadbolt latch assembly of claim 1, wherein the housing is configured such that there are no moving structures both exterior of the housing above the slide and located in a cross bore in a door.

9. A deadbolt latch assembly comprising:

a housing;

a bolt movable relative to the housing between an extended position and a retracted position;

a slide located inside the housing and coupled to the bolt; wherein the slide includes a plurality of slots;

a pivot member that includes a plurality of cam members extending therefrom, wherein each cam member of the plurality of cam members is configured to extend through and engage with a corresponding one of the plurality of slots on the slide, wherein the pivot member defines a bore therethrough that is dimensioned to receive a tailpiece of a deadbolt locking assembly to rotate the pivot member;

wherein the pivot member rotates about 180 degrees in a first direction to extend the bolt to the extended position; and wherein the bolt extends at least partially out of the housing to the extended position in response to rotation of the pivot member in the first direction such that the cam members extend through and engage with the slots of the slide to cause the slide to move and thereby extend the bolt to the extended position, and wherein the bolt retracts from the extended position to the retracted position in response to rotation of the pivot member in a second direction such that the cam members extend through and engage with the slots of the slide to cause the slide to move and thereby retract the bolt to the retracted position.

10. The deadbolt latch assembly of claim 9, wherein each of the plurality of cam members extends radially from the pivot member.

11. The deadbolt latch assembly of claim 9, wherein the pivot member rotates in the second direction about 180 degrees to retract the bolt from the extended position to the retracted position.

12. The deadbolt latch assembly of claim 9, wherein the plurality of cam members includes three spaced apart fingers, and wherein each of the three fingers extends radially from the pivot member.

13. The deadbolt latch assembly of claim 12, wherein each of the three fingers engages a corresponding one of the plurality of slots on the slide such that rotation of the pivot member moves the slide.

14. The deadbolt latch assembly of claim 9, wherein the plurality of cam members uniformly spread torque load when the pivot member is rotated.

15. The deadbolt latch assembly of claim 9, wherein the pivot member is contained in the housing.

16. A deadbolt latch assembly comprising:

a housing formed to define an opening;

a bolt movable relative to the housing between an extended position and a retracted position;

a slide coupled to the bolt, wherein the slide includes at least one slot;

a pivot member that includes at least one cam member extending therefrom, wherein the at least one cam member is configured to extend through and engage with the at least one slot, wherein the pivot member defines a bore therethrough that is dimensioned to receive a tailpiece of a deadbolt locking assembly to rotate the pivot member;

wherein the housing is configured so that the at least one cam member moves within the opening of the housing and is not located exterior of the housing when extended through and engaged with the at least one slot; and wherein the bolt extends at least partially out of the housing to the extended position in response to rotation of the pivot member in a first direction such that the at least one cam member extends through and engages with the at least one slot of the slide to cause the slide to move and thereby extend the bolt to the extended position, and wherein the bolt retracts from the extended position to the retracted position in response to rotation of the pivot member in a second direction such that the at least one cam member extends through and engages with the at least one slot of the slide to cause the slide to move and thereby retract the bolt to the retracted position.

17. The deadbolt latch assembly of claim 16, wherein the pivot member rotates in the first direction about 180 degrees to extend the bolt to the extended position.

18. The deadbolt latch assembly of claim 16, wherein the pivot member rotates in the second direction about 180 degrees to retract the bolt from the extended position to the retracted position.

19. The deadbolt latch assembly of claim 16, wherein the at least one cam member includes three spaced apart fingers, and wherein each of the three fingers extends radially from the pivot member.

20. The deadbolt latch assembly of claim 19, wherein the at least one slot comprises a plurality of slots, and wherein each of the three fingers engages a corresponding one of the plurality of slots on the slide such that rotation of the pivot member moves the slide.

21. The deadbolt latch assembly of claim 16, wherein the at least one cam member uniformly spreads torque load when the pivot member is rotated.

22. The deadbolt latch assembly of claim 16, wherein the housing is configured so that there are no moving structures both exterior of the housing above the slide and located in a cross bore in a door.

* * * * *